United States Patent [19]

Van Horn

[11] 4,420,800

[45] Dec. 13, 1983

[54] REFLECTOR LAMP WITH SHAPED REFLECTOR AND LENS

[75] Inventor: David D. Van Horn, East Cleveland, Ohio

[73] Assignee: General Electric Company, Schenectady, N.Y.

[21] Appl. No.: 349,334

[22] Filed: Feb. 16, 1982

Related U.S. Application Data

[63] Continuation-in-part of Ser. No. 218,932, Dec. 22, 1980, abandoned.

[51] Int. Cl.[3] ..... F21V 7/00

[52] U.S. Cl. ..... 362/297; 362/307; 362/308; 362/309; 362/310; 362/346; 362/347; 362/375

[58] Field of Search ..... 362/297, 307, 308, 309, 362/310, 346, 347, 375

[56] References Cited

U.S. PATENT DOCUMENTS

| | | | |
|---|---|---|---|
| 3,900,727 | 8/1975 | Hutz | 362/346 |
| 3,944,810 | 3/1976 | Grindle | 362/346 |
| 4,218,727 | 8/1980 | Shemitz et al. | 362/346 |

*Primary Examiner*—Stephen J. Lechert, Jr.

*Attorney, Agent, or Firm*—John P. McMahon; Philip L. Schlamp; Fred Jacob

[57] ABSTRACT

A reflector lamp with a shaped reflector and lens. The reflector is generally parabolic, to reflect light frontwardly. Some of the direct light from the light source is not reflected, and diverges in a beam pattern that would be wasted; the lens refracts this divergent light in a more frontwardly and useful direction. For a floodlight, the lens converges the reflected light rays into a cross-over pattern to provide a flood beam pattern.

18 Claims, 3 Drawing Figures

REFLECTOR LAMP WITH SHAPED REFLECTOR AND LENS

REFERENCE TO RELATED APPLICATIONS

This application is a continuation-in-part of copending application Ser. No. 218,932, filed Dec. 22, 1980 and now abandoned.

U.S. Patent Application Ser. No. 352,741, filed Feb. 26, 1982, of Reiling, Putz, and Van Horn, entitled "Reflector Lamp" assigned to the same assignee of the present invention and which is a continuation-in-part of U.S. Patent Application Ser. No. 165,610, filed July 3, 1980, now abandoned.

BACKGROUND OF THE INVENTION

The invention is in the field of reflector lamps, such as floodlights and spotlights, having reflectors and lenses. In such lamps, the light source is deeply recessed in a concave reflector which reflects frontwardly in a desired beam pattern substantially more than half of the total light output of the lamp.

The above-referenced patent applications Ser. Nos. 165,610 and 352,741 disclose a reflector lamp having a concave reflector comprising parabolical and spherical sections, for projecting a pattern of parallel light rays in a frontward direction. In the use of a concave reflector lamp, there is an undesirably wasted amount of light which emanates from the light source and is not reflected but radiates in a divergent cone pattern through the front of the reflector.

SUMMARY OF THE INVENTION

Objects of the invention are to provide a reflector lamp, combined with a lens, having improved optical efficiency which permits a design having lower power consumption, and to achieve this with a reasonably compact lamp.

The invention comprises, briefly and in a preferred embodiment, a reflector lamp having a concave reflector, which may have one or more parabolic sections, for reflecting light frontwardly from a finite light source located substantially at the focal point. The light source is deeply recessed in the reflector so as to be at least three times as far from the front opening of the reflector as from the reflector vertex so that substantially more than half of the total light from the light source is reflected by the reflector. A lens is positioned over the front of the reflector and is contoured at least near the outer edge thereof to refract frontwardly at least some of the unreflected divergent light emanating directly from the light source. For a floodlight, substantially the entire lens is contoured to refract and converge light rays including the reflected light rays, so that the reflected light rays converge into a crossover pattern to provide a flood beam pattern.

BRIEF DESCRIPTION OF THE DRAWING

FIG. 3 is a side view of the lamp and a floodlight beam pattern.

DESCRIPTION OF THE PREFERRED EMBODIMENT

Figure 1:
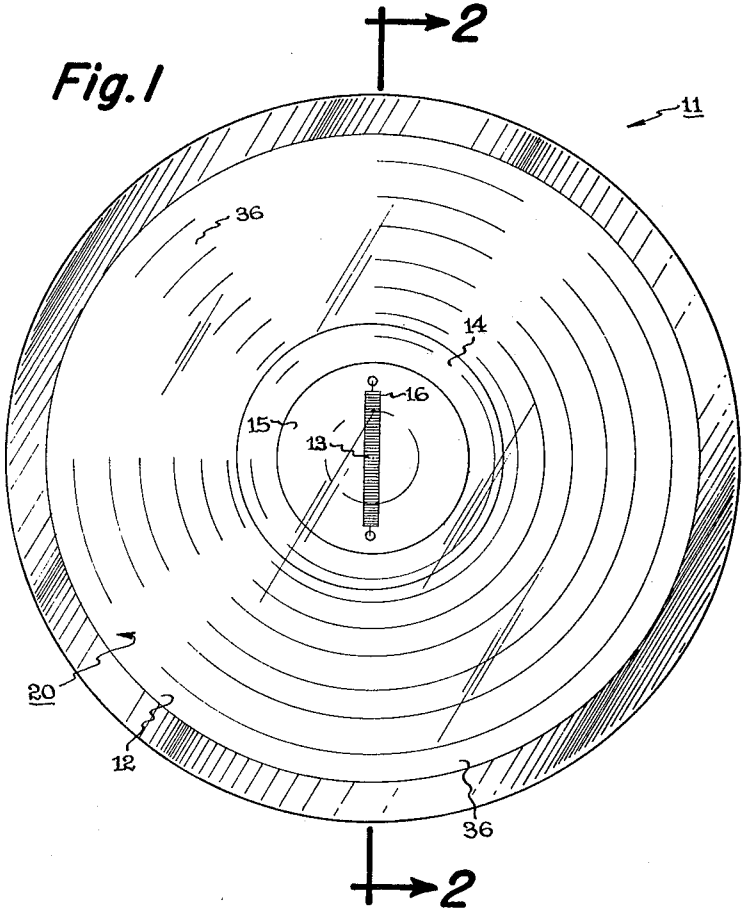
FIG. 1 is a front view of a reflector lamp in accordance with a preferred embodiment of the invention.

A preferred embodiment of the invention, as shown in the drawing, comprises a reflector lamp having a concave reflector 11 shaped to have a front reflector section 12 which has a substantially parabolic contour with respect to a focal point 13, an intermediate reflector section 14 which has a substantially spherical contour with respect to the focal point 13, and a rear reflector section 15 which has a substantially parabolic contour with respect to the focal point 13. The cross-section of the reflector 11 perpendicular to its principal optical axis is circular, as shown in FIG. 1. Thus, each of the three reflector sections is defined by a surface of revolution of a parabolic or a circular curve. A finite light source, that is, a light source that is neither infinite nor infinitesimal in size such as a filament 16 is centered at the focal point 13 and generally is either perpendicular or parallel to the lamp axis. Preferably the light source 16 is located in or near the plane 17 of mutual truncation at the joinder of the front section 12 and intermediate section 14, as shown in the drawing.

To achieve the maximum practical optical efficiency, reflector lamps are designed to have the reflector 11 as deep as is feasible, to provide a large primary reflecting surface area 12 for reflecting substantially more than half of the total light into the desired beam pattern. Additionally, substantially less than half of the total amount of light emanates directly and unreflected from the light source 16 through the front of the reflector in a divergent pattern whereby some of the light is wasted because it falls outside of the desired beam pattern. Thus, the light source 16 is deeply recessed in the reflector and is typically at least three times the distance from the front plane or rim 31 of the reflector than from the vertex, or virtual vertex 12' in the embodiment shown, of the primary reflecting surface 12. The desired long depth of the reflector is limited by practical considerations such as not wanting unduly great size, weight, bulk, and cost of the reflector. Alternative light sources can be employed in place of the filament 16, such as a halogen regenerative-cycle incandescent lamp or an arc discharge lamp. A shaped lens 20 is placed or sealed over the front opening of the reflector 11, primarily to modify the light pattern, as will be described below. Additionally the lens serves to protect the reflecting surface and thereby keeps the reflector surface clean. Furthermore a cover or lens is required if the light souce is a bare filament 16. The reflector 11 can be made of molded glass, its inner surface being coated with aluminum or silver to provide a reflective surface. Preferably the filament 16 is made of tungsten and is mounted on a pair of lead-in wires 18, 19 of suitable material such as nickel.

Although in the preferred embodiment the focal points of the parabolic and spherical sections are substantially confocal, the focal point of the spherical intermediate section need not be located at substantially the same spatial position as the focal points of the parabolic sections while remaining within the scope of this invention. More specifically, the focal point of the spherical section can be located between the common focal points of the parabolic sections and a point spaced therefrom located not greater than ten times the maximum light source dimension which is perpendicular to the light source major axis. In such an embodiment, the finite light source would be positioned substantially at the common focal points of the parabolic sections.

Similarly, although in the preferred embodiment the finite light source is positioned substantially at the confocal points of the parabolic and spherical sections, the finite light source can be located elsewhere while remaining within the scope of this invention. That is, the light source can be positioned either perpendicular or parallel to the lamp axis and between the confocal points of the parabolic and spherical sections and a point spaced therefrom, located not greater than ten times the maximum light source dimension which is perpendicular to the light source major axis.

Light rays which emanate from the light source 16 at the focal point 13 and which strike the parabolic front reflector section 12, will be reflected in a generally frontward direction, as indicated by the light ray paths 21. Similarly, light rays 22 emanating from the filament 16 and which strike the parabolic rear reflector section 15, will be reflected generally frontwardly.

As is disclosed and claimed in the above-referenced patent applications, the spherical intermediate section 14 is dimensioned with respect to the parabolic front reflector section 12 so that substantially all of the light emanating from the light source 16, other than at focal point 13 and which strikes the spherical intermediate section 14, will be reflected thereby in a direction so as to strike the parabolic front section 12 and be re-reflected thereby in a generally frontward direction. For example, a light ray 26 emanating from the light source 16, strikes the intermediate spherical section 14 and is reflected onto the parabolic front reflector section 12 and is directed frontwardly as shown in FIG. 2.

It is to be noted, however, that light rays reflected by the intermediate spherical section 14 and which emanate from the light source 16 at focal point 13 will not be reflected in a direction so as to strike the parabolic front section 12. More specifically, and as well known in the art, a ray of light emitted from a light source at a specific wavelength and reflected back onto the light source, at that same wavelength, will either be absorbed and/or re-reflected but will never pass through the light source. Thus, any light rays such as light ray 27, emitted from that portion of the light source 16, located at the focal point 13, striking the intermediate spherical section 14 will be reflected back along the original light ray path, due to the optical geometry thereof, and intercept the light source 16 at focal point 13. Assuming that the light ray 27 maintains the same wavelength throughout its path of travel, then upon intercepting the light source 16 at focal point 13, light ray 27 will be absorbed and/or re-reflected thereby. Light ray 27, will never pass through light source 16. Therefore any light rays emitted from the light source 16, at focal point 13, and which strike the intermediate spherical section 14 and maintain the same wavelength throughout their path of travel, cannot contribute to the total light leaving the lamp 11. In more general terms, and as is well known in the art, any portion of the light source whose reflected image coincides with itself or any other portion of the light source will provide no useful light output inasmuch as the reflected image cannot travel through the actual light source.

A preferred method of designing the reflector, is to first design the front section 12 and then design the contour of the spherical section 14. Next, a line is drawn from the rim 31, and through the focal point 13, to the contour line of the intermediate section 14; this point of intersection establishes the joinder plane 28 at the rear of the section 14 where it joins the rear section 15.

Figure 2:
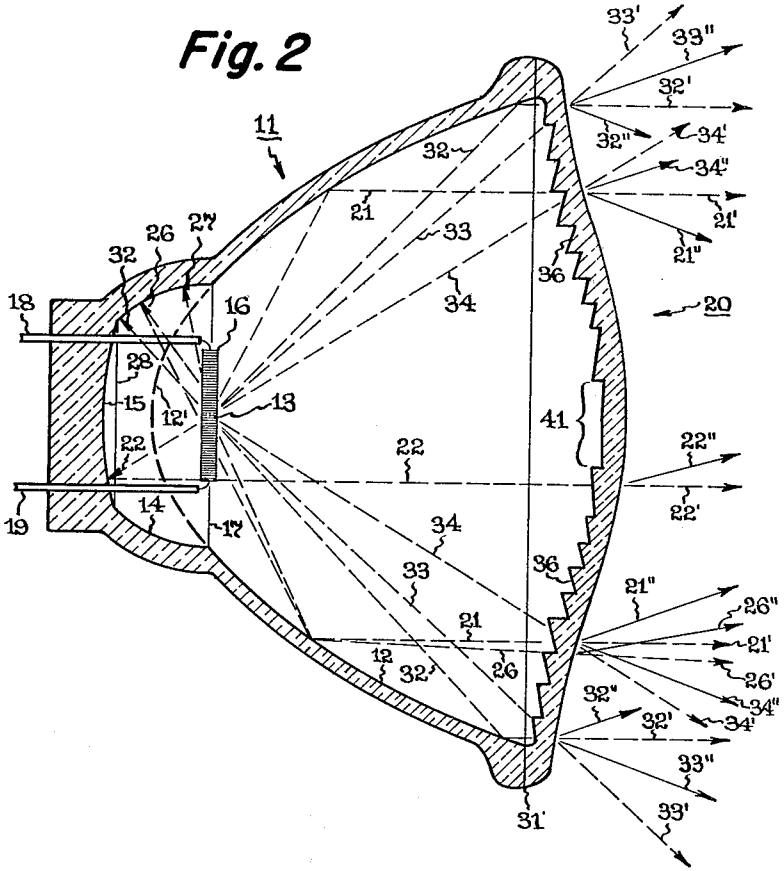
FIG. 2 is a cross section side view taken on the line 2—2 of FIG. 1.

In scientific optical terminology, the breadth of the parabolic reflector curve at the focal point 13 is the latus rectum and is represented in the drawing by the line 17 in FIG. 2, and the vertex is the point on the rear surface directly behind the focal point 13. The vertex of the front parabolic section 12 is the point thereon that would be directly behind the focal point 13 if the parabolic curvature were to be continued behind the focal point 13. Thus the focal point 13 is relatively close to the vertex of the front parabolic curve 12 and is substantially farther from the vertex of the rear parabolic curve 15. The diameter of the spherical intermediate section 14 is essentially equal to the length of the latus rectum 17 of the front parabolic curve 12.

The space defined and surrounded by the spherical intermediate section 14 provides a recess for accommodating the light source 16, and spaces the reflecting surface at the back part of the reflector sufficiently far from the filament 16 to minimize blackening thereof by evaporated filament material, and accomplishes this while retaining an optical efficiency substantially as good as if the entire reflector had a single parabolic curvature.

Some of the light emanating from the source 16 is not reflected by the reflector 11, and emerges from the source 16 in a diverging cone-shaped beam, illustrated by the cone edge pairs of light rays 33. Another illustrative pair of diverging light rays 34 within the aforesaid cone-shaped beam, are also shown. This cone-shaped beam, including the cone edge-defining rays 33 and all other rays such as rays 34 contained therein would, but for the lens 20, emerge through the front of the reflector 11 in straight continuation rays 33', 34'. All of the light rays of the cone-shaped beam, except for those on the optical axis, are divergent and inconsistent with the desired frontward substantially parallel ray pattern provided by the reflector 11, and (but for the lens 20) will fall outside the desired beam pattern and will be wasted light in most applications. The closer the cone rays are to the edge defining rays 33, the more divergent they will be, these edge rays 33 being the most divergent and other cone rays such as rays 34 which are slightly within the cone edge rays 33 being only slightly less divergent.

The light rays 21, 32, 33, and 34 are shown as pairs thereof symmetrically arranged about the optical axis of the reflector 11, to better illustrate the light distribution patterns in the cross-sectional view of FIG. 2 and to facilitate illustration in FIG. 3 of a projected floodlight beam pattern.

In accordance with the present invention, the lens 20 is contoured, at least near its outer rim, to refract in a more frontwardly direction at least some of the divergent "stray" light rays from the light source, and the lens may be further contoured to provide a floodlight beam pattern. The preferred contouring of the lens is in the form of concentric prisms 36, preferably on its inner surface, of the Fresnel lens type.

In FIG. 2, the dashed-line light ray representations 21, 22, 26, 32, 33, etc. represent light rays from the source 16, both reflected and nonreflected within the reflector 11, and the dashed-line representations indicated by primed numbers 21', 22', 26', 32', 33' etc. of these light rays in front of the light unit indicate what the ray patterns and directions would be without the presence of the lens 20. The solid-line representations, indicated by double-primed numbers 21", 22", 26", 32", 33" etc. of these light rays in front of the lens 20 indicate their patterns and directions as modified by the functioning of the lens in accordance with the invention. Furthermore, as illustrated in FIG. 2, although light ray 26' is not strictly parallel to reflected light rays 21' and 32', all of which are reflected by the front parabolic section 12, the angles between light ray 26' and light rays 21' and 32' are sufficiently small such that 26' is substantially parallel to light rays 21' and 32' and thus conforms to the desired frontward substantially parallel ray pattern to be provided by the reflector 11.

In accordance with the first-mentioned embodiment of the invention, the concentric prisms 36 are provided on the inner surface of the lens 20 and only near the outer periphery thereof, for example in an outer region of the lens so as to intercept all of the divergent light rays between and including the rays 33 and 34. These prisms 36 are shaped to be optically convergent, so as to refract the divergent light rays 33, 34 and the divergent rays therebetween, in a more frontwardly direction as indicated by the solid-line rays 33" and 34", and thus more nearly into the desired useful overall beam pattern. At the same time, the reflected and frontwardly directed light rays including the rays 21, 32 will be converged inwardly by the lens prisms, as indicated by the solid-line rays 21" and 32", and will cross over at a region 38 (FIG. 3) in front of the lens 20 and thereafter be divergent and directed somewhat out of the desired beam pattern. For purposes of clarity, rays 22 and 26 have not been shown. It is to be understood, however, that rays 22 and 26 similar to rays 21 and 32, would converge inwardly due to the lens prisms and cross over other converging rays such as 21 and 32 at regions similar to region 38. Thus the lens prisms serve two functions, namely, to adjust the direction of the unreflected diverging light rays, that is, the "spill" light, such as rays 33 and 34, in a more frontwardly direction and to direct the substantially parallel light rays such as 21 and 32 in a more inwardly direction. In accomplishing these functions the lens typically is thinnest near the edge thereof.

A compromise can be found in the lens design and its degree of optical convergence, so that more useful light is gained in the desired overall beam pattern by the frontward refraction of the otherwise divergent rays 32', 33' than may be lost due to the convergent refraction of the otherwise substantially parallel rays 21', 22', 26', and 32'. This increases the useful light output and/or permits the use of a lower wattage filament 16 thus conserving electrical energy. In this embodiment of providing a lens 20 with concentric prisms 36 only near the periphery of the lens, the reflected and nonreflected light rays from filament 16 which pass through the lens central region, such as defined by a circumference bounded by the light rays 21, are substantially unaffected by the lens.

In another embodiment of the invention, a floodlamp having improved electrical and optical efficiency is achieved by providing the light-reflecting concentric prisms 36 over substantially the entire inner surface of the lens 20, as shown in FIG. 2. These prisms need not be provided at the reflector's center area 41 where they would be relatively ineffective. Referring again to FIG. 3, in accordance with the floodlight of the invention, the lens 20 refracts the nonreflected divergent light rays in a more frontwardly divergent pattern, exemplified by the light rays 33" and 34", which is in the desired divergent floodlight beam pattern. Also, the lens 20 refracts the reflected parallel light beams in a convergent manner to produce a crossover pattern of rays which thereafter are divergent in the desired floodlight pattern. For example, the above-described light rays 21" and 32" crossover at region 38 in front of the lens 20 and thereafter diverge generally in the desired floodlight beam pattern. For more completeness, FIG. 3 shows an additional pair of projected light rays 42" and 43" which have been reflected by the reflector 11 toward the lens 20 at an intermediate diameter region 44 thereof and refracted by the lens to converge and crossover at a region 46 in front of the lens and thereafter diverge generally in the desired beam pattern. Unreflected light rays passing through the lens at its intermediate diameter region 44 will be refracted and projected approximately frontwardly, thus contributing to the overall flood beam illumination. In lamps built according to the invention, the crossover regions 38, 46 lay in the range of about 5 to 20 inches in front of the lens 20.

Thus in the two embodiments described heretofore the lens design provides for a maximum beam candlepower, that is, beam intensity, along the lamp axis. Additionally the lens provides for half of the maximum beam candlepower at approximately 15.5° or 7° from the lamp axis for a floodlamp or spotlamp, respectively.

A unique feature of the invention is the divergent projection of some light rays 33" and 34" and the convergent projection of other light rays 21', 32", 42", and 43" which light rays cross over and become divergent in a manner compatible with the divergent rays 33" and 34" to provide a desired floodlight beam pattern. The concentric prisms 36 need not have identical refraction angles; the refraction angles of some or all of the various prisms can be different from one another to tailor the light distribution for uniform intensity or other desired characteristics is the projected light beam. By thus providing the lens 20, in cooperation with the reflector 11, most of the projected light rays are in the desired beam pattern and relatively little light is wasted, thus improving efficiency and conserving electrical energy.

While preferred embodiments of the invention have been shown and described, various other embodiments and modifications thereof will become apparent to persons skilled in the art, and will fall within the scope of the invention as defined in the following claims.

What I claim as new and desire to secure by Letters Patent of the United States is:

1. A reflector lamp comprising a finite light source positioned substantially at the focal point of a reflector, said reflector having a substantially parabolic front section as a primary reflecting surface, a substantially spherical intermediate section, and a substantially parabolic rear section, each of said sections having substantially the same common focal point, said light source located at least three times as far from the front opening of said reflector as from the vertex of said primary reflective surface so that substantially more than half of the total light is reflected by the reflector, and a lens positioned over the front of said reflector and contoured at least near the outer edge thereof to refract in a more frontwardly direction at least some of the unreflected divergent light from said light source.

2. A reflector lamp as claimed in claim 1 wherein said lens contour comprises concentric prisms.

3. A reflector lamp as claimed in claim 2 wherein said concentric prisms are on the inner surface of said lens.

4. A reflector lamp as claimed in claim 1 wherein said reflector is dimensioned so that substantially all light rays from said light source which are reflected by said spherical intermediate section are re-reflected by said parabolic front section.

5. A reflector lamp as claimed in claim 1 wherein substantially an entire surface of said lens is contoured to refract light more inwardly, whereby light reflected by said reflector is converged into a crossover pattern and thereafter diverges to provide a floodlight pattern in cooperation with said refracted unreflected light.

6. A reflector lamp as claimed in claim 5 wherein said lens contour comprises concentric prisms.

7. A reflector lamp as claimed in claim 6 wherein said concentric prisms are on the inner surface of said lens.

8. A reflector lamp as claimed in claim 5 wherein said reflector is dimensioned so that substantially all light rays from said light source which are reflected by said spherical intermediate section are re-reflected by said parabolic front section.

9. A reflector lamp comprising a finite light source positioned substantially at the focal point of a reflector, said reflector having a substantially parabolic front section as said primary reflective surface, a substantially spherical intermediate section, and a substantially parabolic rear section, each of said sections having substantially the same common focal point, said light source located at least three times as far from the front opening of the reflector as from the vertex of said primary reflective surface so that substantially more than half of the total light from said light source is reflected frontwardly by said reflector, and substantially less than half of the total light emerges at the reflector front opening unreflected and in the form of a divergent cone of light, and a lens positioned over the front of said reflector and contoured to refract substantially all of said light in a more inwardly direction whereby said unreflected light remains divergent and said reflected light is converged into a crossover pattern and thereafter diverges to provide a floodlight pattern in cooperation with said refracted, unreflected light.

10. A reflector lamp as claimed in claim 9 wherein said lens causes the divergent angles of said reflected light after crossover to be approximately the same as the divergent angles of said unreflected light in the projected light pattern.

11. A reflector lamp as claimed in claim 9 wherein said reflector is dimensioned so that substantially all light rays from said light source which are reflected by said spherical intermediate section are re-reflected by said parabolic front section.

12. A reflector lamp as claimed in claim 9 wherein said lens contour comprises concentric prisms.

13. A reflector lamp as claimed in claim 12 wherein said concentric prisms are on the inner surface of said lens.

14. A reflector lamp as claimed in claim 1 or 9 wherein said finite light source lies substantially in a plane perpendicular to the lamp axis and intersects said focal point.

15. A reflector lamp as claimed in claim 1 or 9, wherein said finite light source lies substantially in a plane perpendicular to the lamp axis; said plane located at a distance from said focal point which is not greater than ten times the maximum light source dimension which is perpendicular to the light source major axis.

16. A reflector lamp as claimed in claim 1 or 9 wherein said finite light source lies substantially in a plane which includes the lamp axis and said focal point.

17. A reflector lamp as claimed in claim 1 or 9 wherein said finite light source lies substantially in a plane parallel to the lamp axis; said plane positioned at a distance from said focal point which is not greater than ten times the maximum light source dimension which is perpendicular to the light source major axis.

18. A reflector lamp as claimed in claim 4, 8 or 11 wherein said focal point of said spherical section is located between said common focal points of said parabolic sections and a point spaced therefrom located not greater than ten times the maximum light source dimension which is perpendicular to the light source major axis.

* * * * *